US006619498B2

(12) United States Patent
von Holdt, Jr.

(10) Patent No.: US 6,619,498 B2
(45) Date of Patent: Sep. 16, 2003

(54) PLASTIC CONTAINER AND LID CONSTRUCTION

(76) Inventor: John W. von Holdt, Jr., 3121 Mary Kay La., Glenview, IL (US) 60025

( * ) Notice: Subject to any disclaimer, the term of this patent is extended or adjusted under 35 U.S.C. 154(b) by 0 days.

(21) Appl. No.: 09/925,246

(22) Filed: Aug. 8, 2001

(65) Prior Publication Data

US 2001/0047994 A1 Dec. 6, 2001

Related U.S. Application Data

(63) Continuation of application No. 09/492,199, filed on Jan. 27, 2000, now abandoned.

(51) Int. Cl.[7] ..... B65D 17/00
(52) U.S. Cl. ..... 220/276; 220/790; 220/792
(58) Field of Search ..... 220/276, 266, 220/780, 790, 792

(56) References Cited

U.S. PATENT DOCUMENTS

| | | | | |
|---|---|---|---|---|
| 4,210,258 A | | 7/1980 | von Holdt | |
| 4,308,970 A | | 1/1982 | von Holdt | |
| 4,375,948 A | | 3/1983 | von Holdt | |
| 4,380,305 A | | 4/1983 | von Holdt | |
| 4,444,332 A | * | 4/1984 | Widen et al. | 220/792 |
| 4,452,382 A | | 6/1984 | von Holdt | |
| 4,512,493 A | | 4/1985 | von Holdt | |
| 4,512,494 A | | 4/1985 | von Holdt | |
| 4,574,974 A | | 3/1986 | von Holdt | |
| 4,735,337 A | * | 4/1988 | von Holdt | 220/276 |
| 5,730,309 A | * | 3/1998 | Jiradejnunt et al. | 220/790 X |

* cited by examiner

*Primary Examiner*—Steven Pollard
(74) *Attorney, Agent, or Firm*—Banner & Witcoff

(57) ABSTRACT

A combination molded plastic bucket and lid includes a series of outwardly extending ribs on the top edge of the bucket and inwardly extending flanges on a depending outer skirt of the lid which engage with the bucket ribs to provide a wedging action that holds the lid tightly in a sealing position on the top of the bucket. A zig-zag tear strip permits removal of a portion of the lower most lid flange. The top of the bucket includes a groove adapted to receive a projection or tongue seal.

2 Claims, 8 Drawing Sheets

FIG.1
(PRIOR ART)
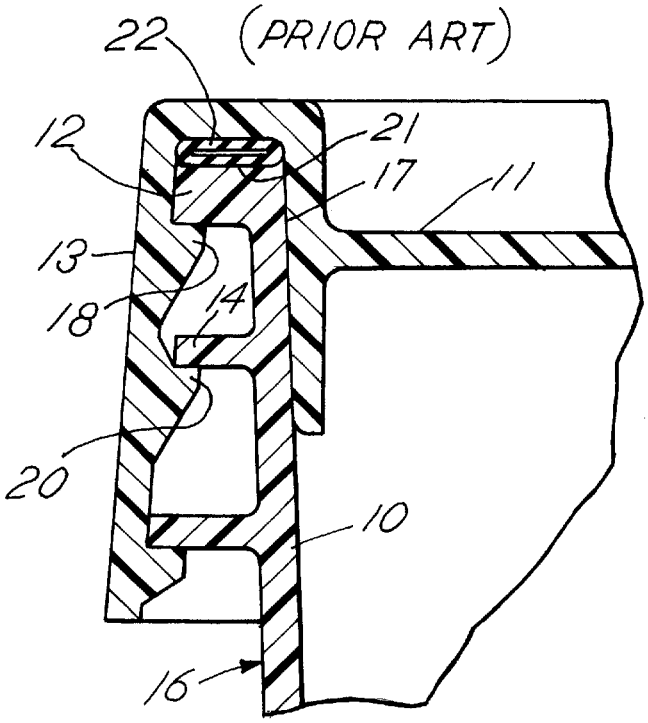
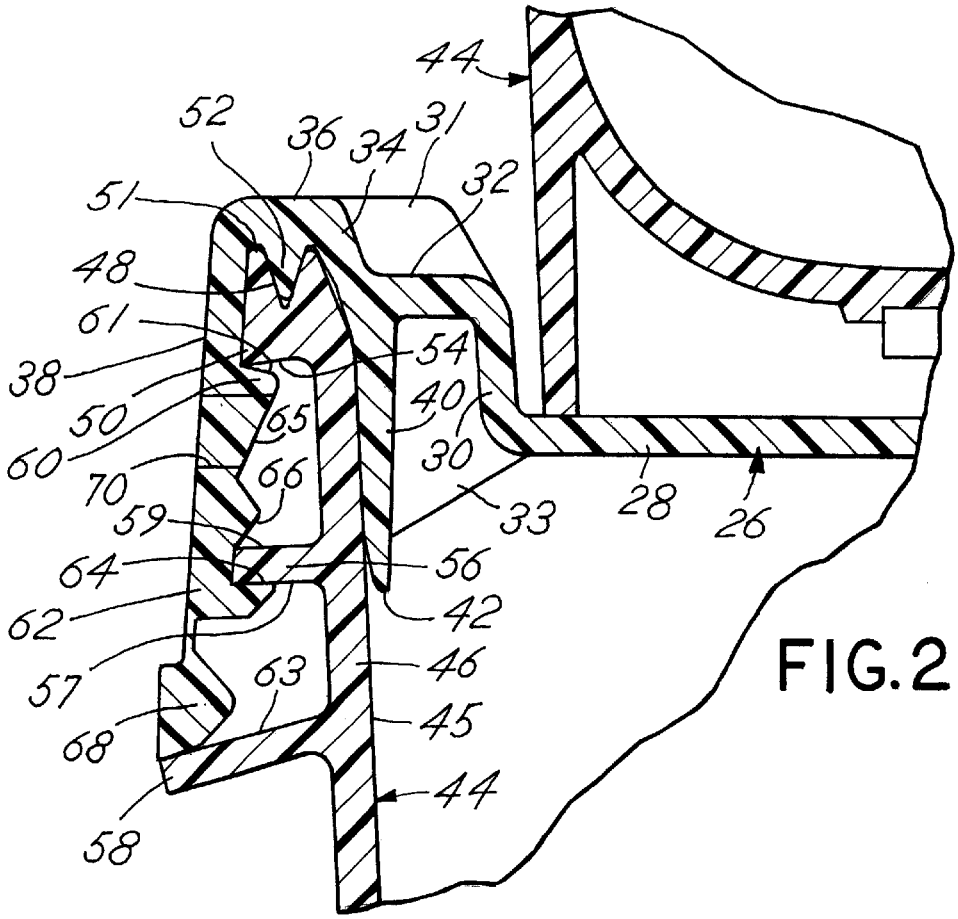
FIG.2

PLASTIC CONTAINER AND LID CONSTRUCTION

CROSS REFERENCE TO RELATED APPLICATION

This is a continuation of Ser. No. 09/492,199 filed Jan. 27, 2000, now abandoned, and for which priority is claimed.

BACKGROUND OF THE INVENTION

The present invention relates to a molded plastic container or bucket and a compatible lid wherein the lid is removably secured to the open end of the container.

Many designs of molded plastic buckets or containers are known, for example, as disclosed in the following patents of John W. Von Holdt, Sr.: U.S. Pat. Nos. 4,375,948; 4,574,974; 4,512,494; 4,512,493; 4,452,382; 4,380,305; 4,308,970; and 4,210,258. Buckets or containers for food, paint, solvents and chemicals have been made from molded plastic materials in accord with the teachings of such patents. However, molded plastic buckets may lack the strength of buckets fabricated from metal. Thus special designs for plastic buckets may be adopted to obtain, for example, desired structural integrity, hoop strength and stacking strength. Hoop strength relates to the function or characteristic of the container to resist lateral deformation or change in the cross sectional shape of the container when lateral forces act upon the sides of the container. Stacking strength relates to the function or characteristic of the container to support vertical loads such as those which may occur when containers are stacked upon each other.

Also the design of the mouth or open end of a plastic bucket or container and a compatible lid presents a challenge to provide a lid that is properly retained and sealed on the open top of the bucket. Von Holdt in U.S. Pat. No. 5,538,154 entitled Snap-On Flexible Lid discloses a plastic lid with a peripheral flange constructed to enhance the "drop strength" of the lid while retaining flexibility adequate to permit removal of the lid from a container. Drop strength relates to the function or characteristic of the lid to maintain attachment to a container even when dropped from various heights. Von Holdt in U.S. Pat. No. 5,437,386 entitled Container with Tamper-Evident Lid Removal Means discloses additional embodiments of compatible molded plastic bucket and lid constructions.

Attachment of a lid to the open end of a molded plastic bucket often involves frictional or interference engagement or interaction between a rib, lip or groove molded in the open end of the bucket and a circumferential flange projection or groove in the lid. For example, the lid may include a radially, inwardly extending flange, rib or lip that is engaged with an outwardly extending rib on the outside wall of the bucket. A typical prior art lid and bucket combination is depicted in the cross section in FIG. 1. A bucket side wall 10 includes two circumferential, outwardly extending radial ribs 12, 14 which are each cooperative with a separate, inwardly extending circumferential, radial flange, 18, 20 on a skirt 13 of the lid 11. Flanges 18, 20 fit over the bucket ribs 12, 14 and thereby hold or retain the lid 11 on the bucket. The flanges 18, 20 resist release or removal of the lid 11 from the top or open end of the bucket.

Such prior art constructions work well. However, the need for a tamper resistant, improved lid construction for use in combination with a molded plastic bucket has remained.

SUMMARY OF THE INVENTION

In a principal aspect, the present invention comprises a molded plastic bucket or container and a compatible lid combination wherein the bucket includes at least two, radially outwardly extending, generally horizontal flanges or ribs at the top or open end of the bucket, and wherein the lid includes a depending skirt with at least two inwardly extending flanges or ribs that cooperate with the bucket ribs by engaging the bucket ribs. In this manner, the lid is held by cooperative engagement of the lid flanges with the bucket ribs. Further, the lid includes a downwardly extending, circumferential tongue adapted to fit in a circumferential groove in the top edge of the bucket. The profile of the inside of the depending skirt of the lid is shaped to thwart tampering with the seal of the lid on the container. A removable tear seal is also incorporated in skirt of the lid. The tear seal has a zigzag shape which enables removal of portions of the lower lid flange when the seal is removed.

Thus it is an object of the invention to provide an improved molded plastic bucket and lid combination.

A further object of the invention is to provide a molded plastic bucket with outwardly projecting lid retention ribs at the open end of the bucket and a lid with inwardly extending ribs or flanges that hook over the bucket ribs to thereby effect sealing and retention of the lid on the bucket.

Another object of the invention is to provide a bucket design and lid construction which is tamper resistant and which can be made from molded plastic.

Another object of the invention is to provide a molded plastic bucket and lid wherein multiple buckets each closed by a lid may be easily stacked.

A further object of the invention is to provide a combination molded plastic bucket and separable lid wherein the lid includes an improved seal.

Another object of the invention is to provide a combination plastic bucket and lid which incorporates multiple points of contact to effect a seal between the open end of the bucket and the lid.

A further object of the invention is to provide a bucket and lid made from molded plastic which is economical to manufacture, may be made for a reasonable cost of materials, and which has necessary structural integrity and strength, including hoop strength, stacking strength and drop strength.

These and other objects, advantages and features of the invention are set forth in the detailed description which follows.

BRIEF DESCRIPTION OF THE DRAWING

In the detailed description which follows, reference will be made to the drawing, comprised of the following figures:

FIG. 1 is a cross sectional view of a typical prior art lid construction for a molded plastic bucket;

FIG. 2 is a cross sectional view of a first embodiment of the lid and bucket construction of the present invention;

DESCRIPTION OF THE PREFERRED EMBODIMENT

Figure 3:
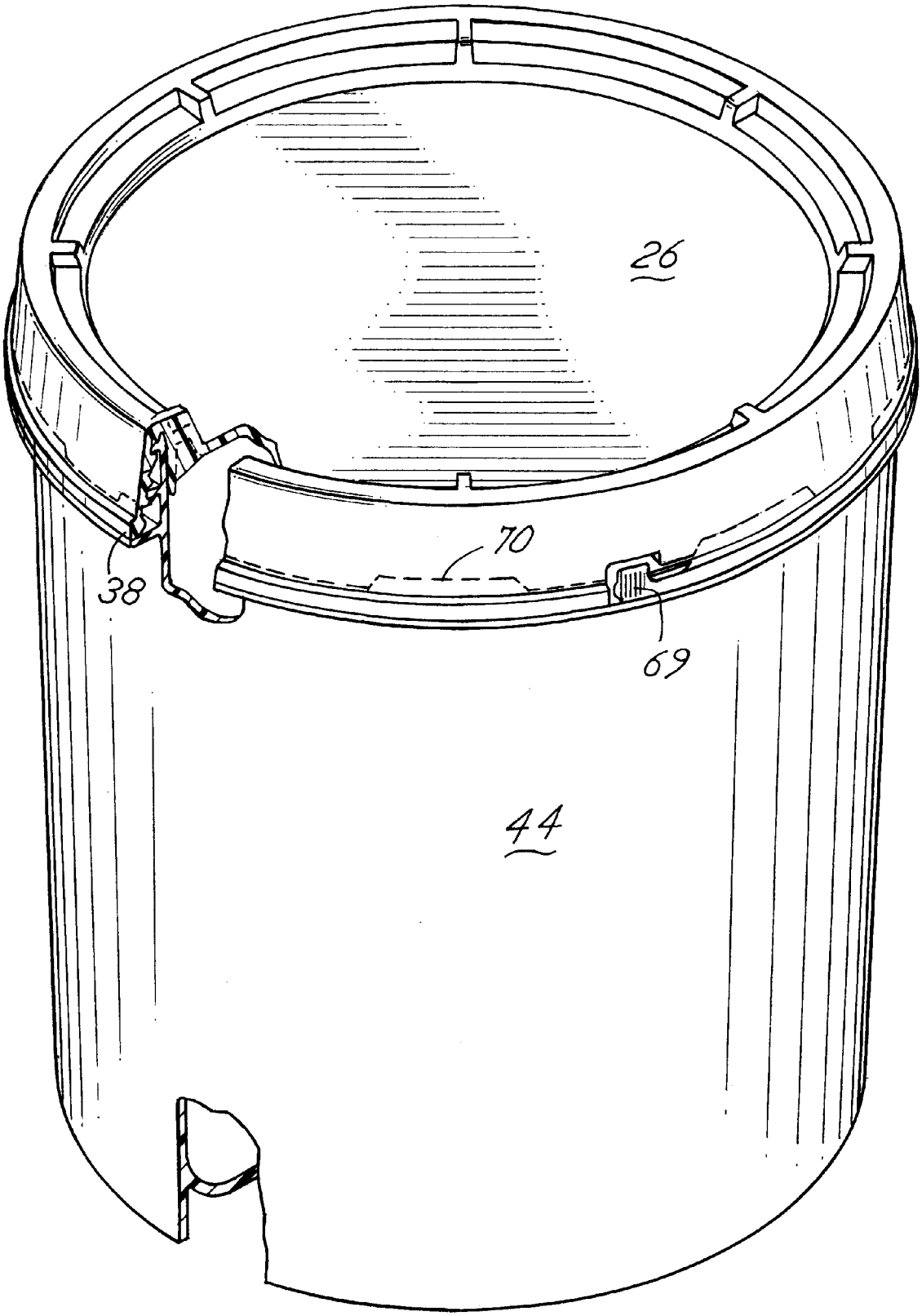
FIG. 3 is an isometric view of the embodiment of the lid and bucket construction of the invention as depicted in FIG. 2 illustrating the attachment of the lid to the bucket.

FIG. 1 illustrates a typical prior art lid 11 and bucket or container 16. The lid 11 includes a depending flange or skirt 13 with radially inwardly extending ribs or flanges 18, 20 that cooperate with radially outwardly extending ribs 12, 14 associated with the top or open end 17 of the side wall 10 of bucket 16. Rib 12 is at the extreme upper, open end 17 of the bucket 16 and has a generally rectangular cross section. Rib 12 extends around the entire circumference of the bucket, pail, or container 16. Similarly, the lower rib 14 extends around the circumference of bucket side wall 10 of bucket 16.

The ribs 12 and 14 are vertically spaced from one another and preferably are continuous with a uniform cross section about the circumference of the bucket 16. The inwardly extending, locking ribs or flanges 18 and 20 of the lid 1 are similarly spaced and engage respectively under the bucket ribs 12 and 14 to hold the lid 1 tightly on bucket 16. An optional flexible gasket 22 may be provided to seal the bottom of lid 10 against upper surface 21 of the outwardly radially extending rib 12 of bucket 16. The container 16 and lid 11 are fabricated from molded plastic material.

FIGS. 2–5 depict a first embodiment of an improved lid 26 and a compatible bucket, pail or container 44. Referring to those figures, lid 26 includes a recessed central panel or section 28 which connects with an upwardly extending, vertical wall or hoop 30 that extends around the circumference of the central section 28. The hoop 30 is integrally connected to a radially outwardly extending annular, planar section 32. The annular section 32 further connects with an upwardly and outwardly extending, inclined wall or hoop section 34 which, in turn, connects with a radially outwardly extending annular planar section 36, connected to a downwardly extending skirt 38 described in greater detail below.

Upwardly and downwardly extending vertical reinforcing fillets 31, 33 respectively are optionally provided at spaced intervals about the periphery of section 32. Fillets 31, 33 function to stiffen the lid 26 including the hoops 30, 34. The lid 26 further includes a downwardly extending, internal lip or flange 40 which projects vertically downwardly from hoop 34 and is parallel to and spaced outwardly from the hoop 30 so that flange 40 will fit against the inside side surface 45 of bucket side wall 46. The flange 40 thus defines another hoop and further functions as an inside lid seal. The flange 40 is, in cross section, in the form of a wedge with a narrow portion of the wedge at the lower end 42 of the flange 40. This shape facilitates sealing of and positioning of the lid 10 onto container or bucket 44 since flange 40 is wedged into engagement with the inside surface 45 of vertical, bucket side wall 46 at the upper end or open end of the bucket 44. The flange 40 is flexible or elastic to promote sealing. Fillets 33 spaced about the circumference of flange 40 insure the flange 40 will be biased toward the wall 46 to effect a seal on surface 45.

The bucket 44 includes an upper, circumferential, outwardly extending, horizontal rib 50. Horizontal top surface 51 of the rib 50 includes a groove or channel 52 for receipt of a downwardly extending tongue or wedge seal 48 of lid 26. In the preferred embodiment, the channel 52 and the seal 48 are fully circumferential. However, other configurations are possible so long as the seal 48 and channel 52 are compatible and provide a sealing function. The radial or horizontal spacing of seal 48 and flange 40 is chosen to enhance a sealing and wedging, grasping or gripping function of the lid 26 onto the bucket 44. An alternative to the seal 48 and groove 52 comprises a compressible seal (not shown) fitted against the top surface 51 of rib 50 similar to the seal of FIG. 1.

The upper rib 50 includes a circumferential, inwardly extending, lower land 54 which acts as a contact surface for a portion of the lid 26 as described below. Spaced vertically downwardly from the radially extending rib 50 on the outside of the bucket side wall 46 is a second circumferential rib 56 which includes a lower, horizontal land 57. As an optional feature, a third generally radial, outwardly extending rib 58 projects from the outside of the bucket side wall 46 for further cooperation with the lid 26. Rib 58 includes an inclined upper land 63.

The lid 26 includes a first inwardly extending locking rib or flange 60 attached to the downwardly extending, outer skirt 38. The locking flange 60 includes a surface 61 which engages against the lower land 54 of bucket rib 50 to tightly retain the lid 10 in position on bucket 44.

The skirt 38 further includes a second, inwardly extending flange 62 which provides a first, latching surface 64 and a second, inwardly inclined face 66. The face 66 extends over a top land or surface 59 of the bucket rib 56. It is noted that the locking flanges 60 and 62 engage respectively with parallel, spaced surfaces 54, 57 of the radially outwardly extending ribs 50, 56 at the mouth of the bucket 44. Thus, the lid flanges 60 and 62 are, in essence, wedged against the ribs 50 and 56 respectively as a result of their spacing and configuration.

Figure 4:
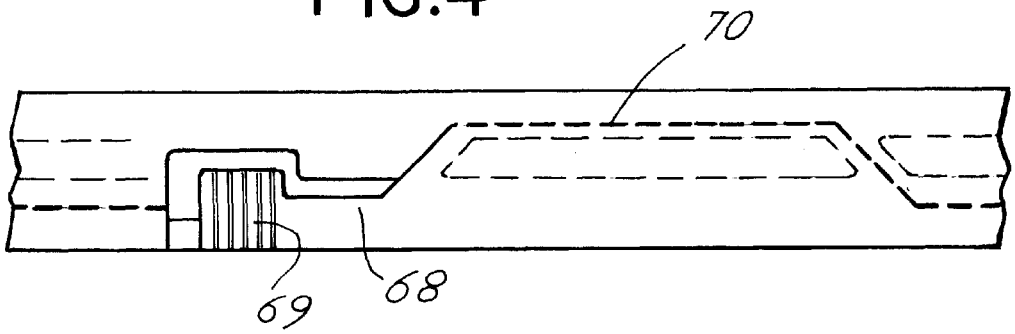
FIG. 4 is an enlarged isometric view of the security release strip associated with the lid of the embodiment of FIG. 2.
Figure 5:
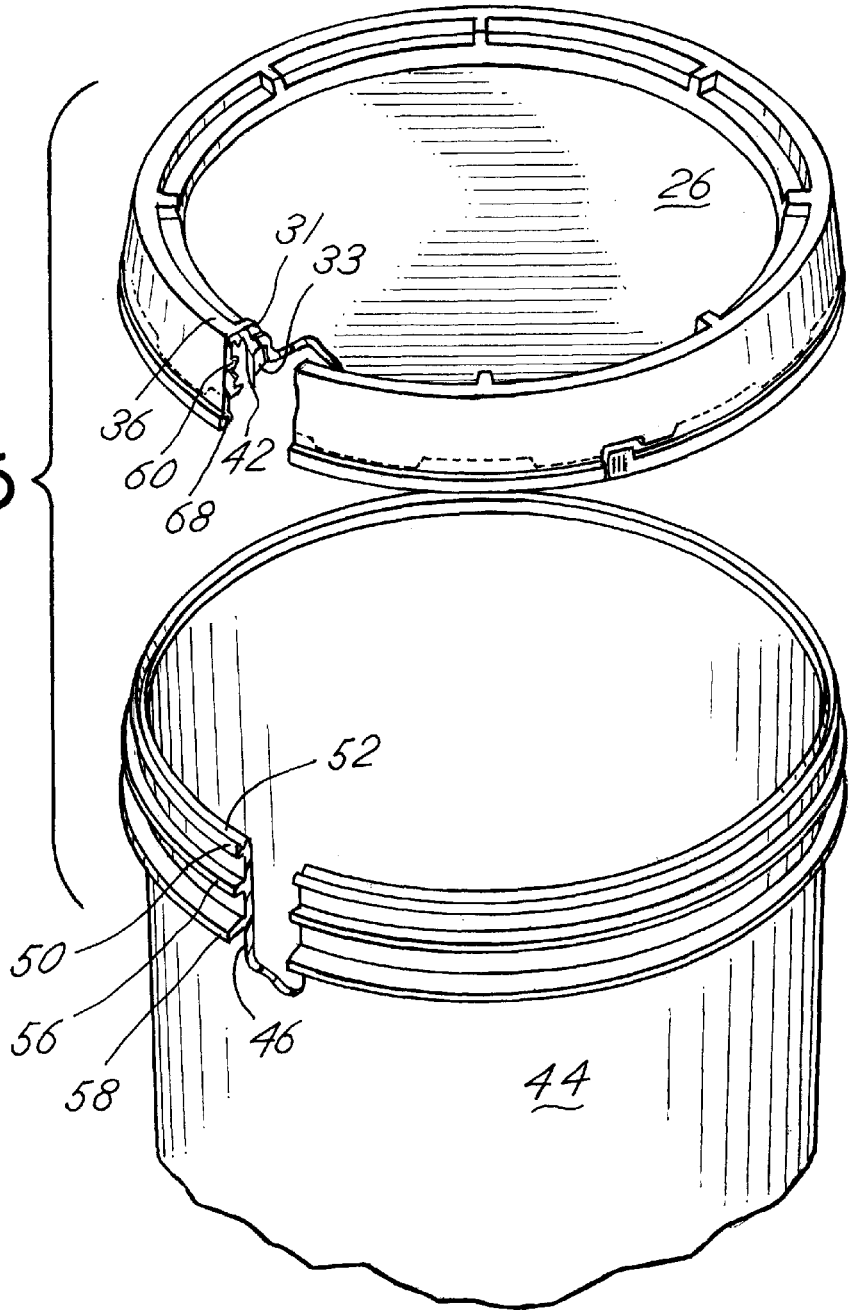
FIG. 5 is an exploded, isometric view of the embodiment of FIG. 2.
Figure 6:
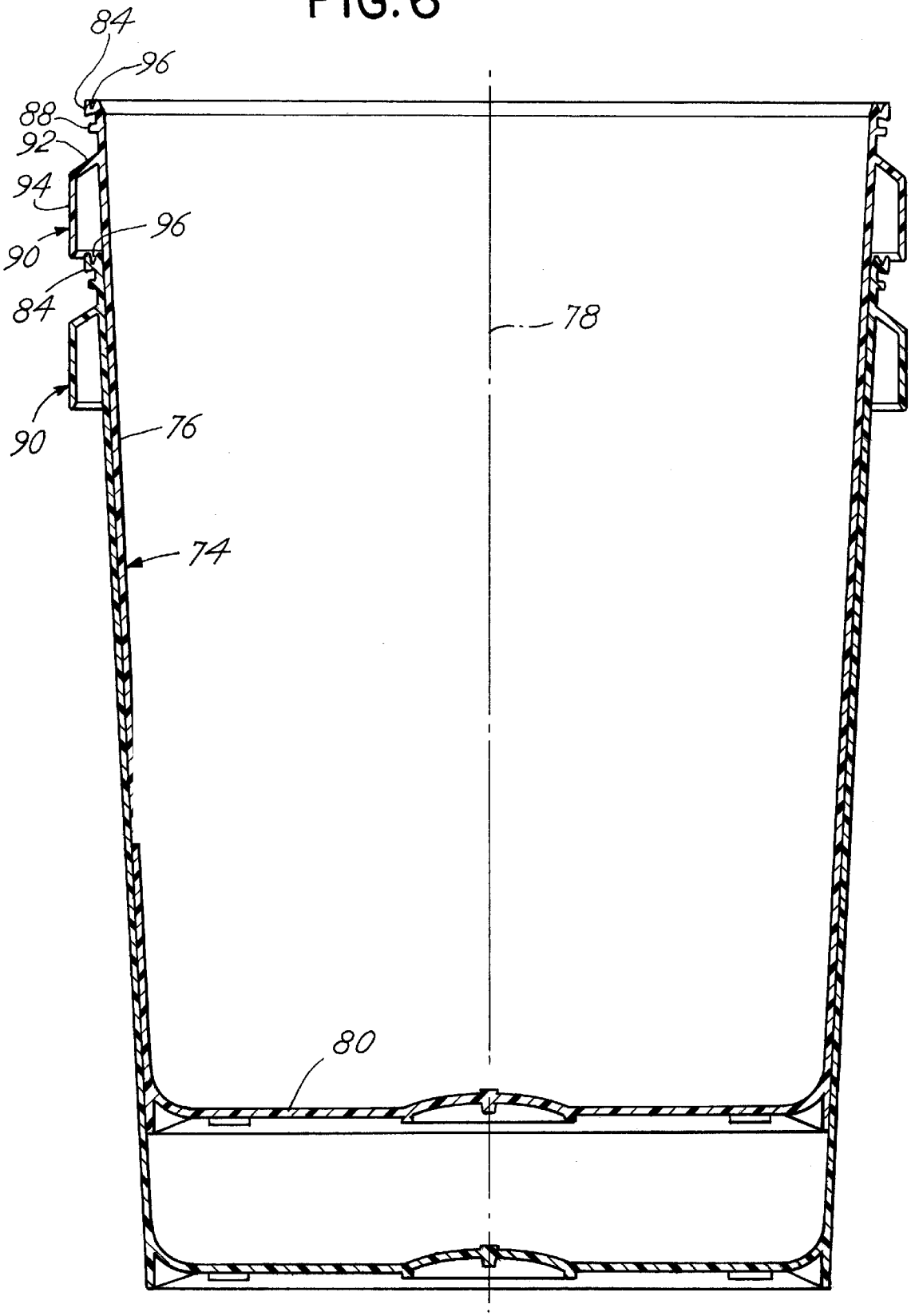
FIG. 6 is a cross sectional view of an alternative embodiment of the invention depicting the manner of stacking multiple unfilled containers or buckets.

A further feature comprises a third inwardly extending rib or flange 68 of lid 26 attached to bottom of the skirt 38. Flange 68 extends inwardly to engage against or be positioned adjacent the top surface 63 of the radially outwardly and downwardly extending rib 58 of the bucket 44. The flange 68 is preferably connected to the skirt 38 along a zigzag tear strip boundary 70 so that a tab 69 molded to provide a free end of flange 68 may be gripped and a tear strip, defined by rib 68 and portions of rib 62, may be removed or torn away from the skirt 38 to enable the lid 26 to be removed from the bucket 44. As depicted in FIGS. 3–5, the tear strip incorporates the rib or flange 68 as well as portions of rib or flange 62. Removal of the tear strip releases the holding force associated with those portions of flange 62 that have been removed. The described configuration therefore facilitates ease of removal as well as replacement of a lid 26 on an open container 44. Also, if flange 68 is subjected to undesired tampering, the flange 68 will tear along a boundary 70 and thus tampering may be evidenced.

In review, the optional wedge seal 48 that fits in the channel 52 enhances sealing of the lid 26 to the bucket 44. Additionally, the downwardly extending flange 40 serves to seal the lid 26 to the bucket 44. The bridging planar radial section 36 connecting the flange 40 and skirt 38 is elastic and deformable so as to enable the skirt 38 to be deformed to permit removal of the lid 26. The inwardly extending flanges 60, 62 and 68 are defined by angled surfaces which facilitate the movement or attachment of the lid 26 by virtue of a snap action wherein the flange or skirt 38 will deform elastically and then snap the various flanges 60, 62 into position to appropriately engage ribs 50,56 of the bucket and wedge the lid 26 against the top of the bucket 44. The angled walls (e.g., face 66 of flange 62) defining the flanges 60, 62 further facilitate the removal and subsequent replacement of the lid 26 after the tear strip has been removed. Face 65 below flange 60 has a similar function.

As depicted in the drawing, the lid 26 includes a recessed central section or panel 28. This panel 28 enables buckets 44 to be stacked one upon the other inasmuch as the side wall 46 of each bucket 44 has, or may have, a draft angle and thus the lower end of the bucket 44 is sized to fit on top of the lid 26 in the area defined by the central section or panel 28.

With the lid construction of the present invention, the wedging and locking functions associated with the design of the edge or skirt of the lid 26 provide an improved and more permanent seal of the lid 26 to the bucket. The use of two inwardly extending flanges to provide a wedging and locking function is preferred along with a zig-zag tear seal which permits removal of part of flange 62. However, it is possible to vary the number of lid flanges and bucket ribs, and to vary positioning of the ribs vertically along the side of a bucket wall in combination with inwardly extending flanges shaped in various configurations and tear strips associated with the lid 26. The sealing channel 52 in the bucket top also may be varied. That is, the channel 52 in bucket 44, which cooperates with the downwardly depending circumferential rib 48 of the lid, may be replaced by a gasket seal of some type, for example. Also, the ribs and flanges are described as continuous, but may be discontinuous. The zig-zag tear seal may also vary in configuration and include one or more flanges 60, 62, 68.

Referring next to FIGS. 6–11, there is illustrated an alternative embodiment of the lid and bucket construction of the invention. A bucket 74 includes a sidewall 76 which is made from molded plastic material and defines a generally frustoconical section about a vertical axis 78. The bucket sidewall 76 extends from the bottom 80 of the bucket upwardly and terminates with the open top 82.

The open top 82 includes a circumferential, first upper rib 84 with a depending groove 86 in the top surface thereof. Spaced from rib 84 is a second rib 86 which extends about the outside circumference of the wall 76.

Positioned below the flange or rib 88 is a depending skirt 90 having an outwardly and vertically downwardly inclined face 92, a generally vertical wall 94 and a connecting inwardly extending molded land or planar section 96 connected to the wall 76. The molded wall 76 in combination with the skirt 90 functions to provide enhanced hoop strength to the container 74.

Figure 7:
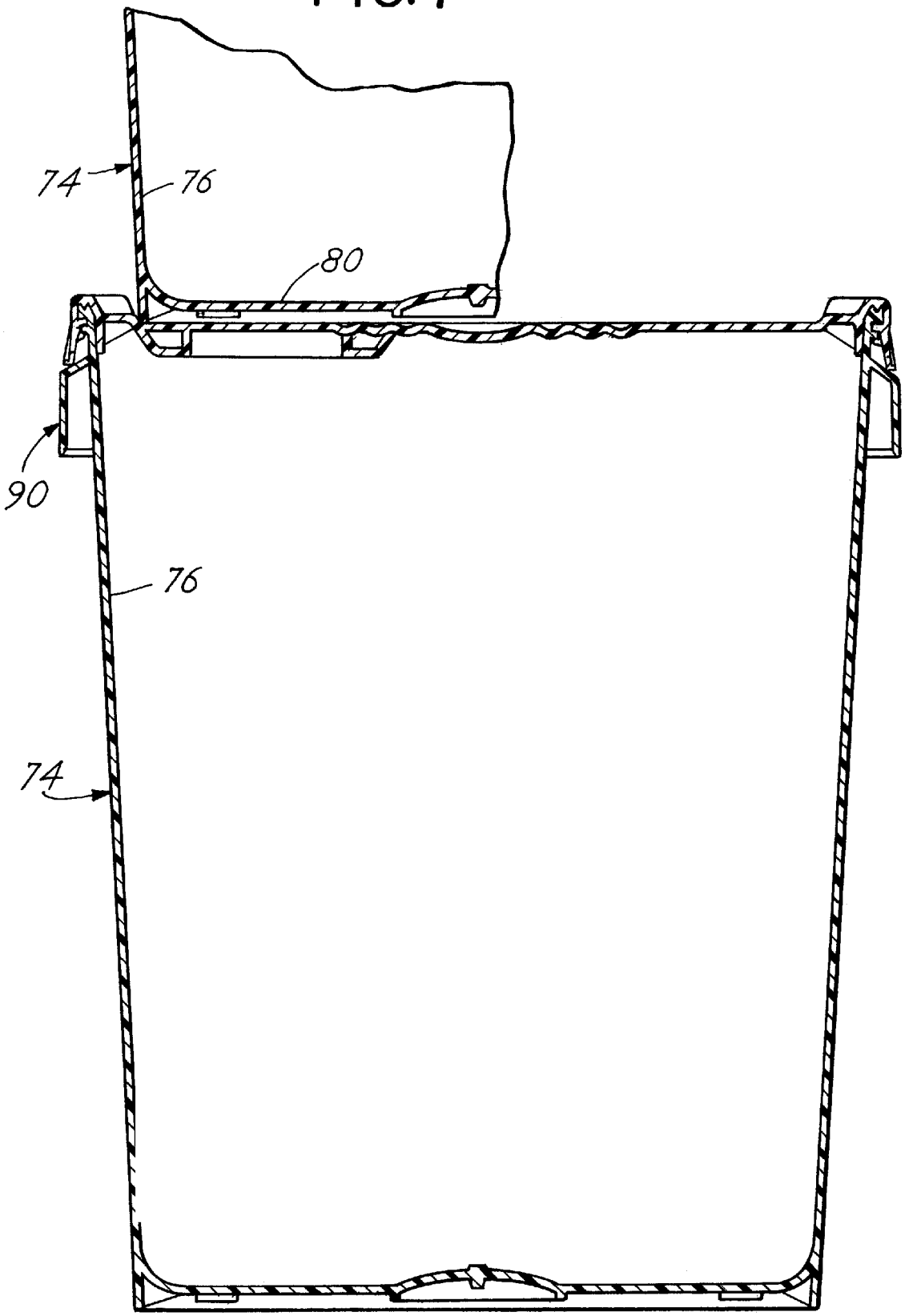
FIG. 7 is a cross sectional view of the bucket of FIG. 6 with a compatible lid.
Figure 8:
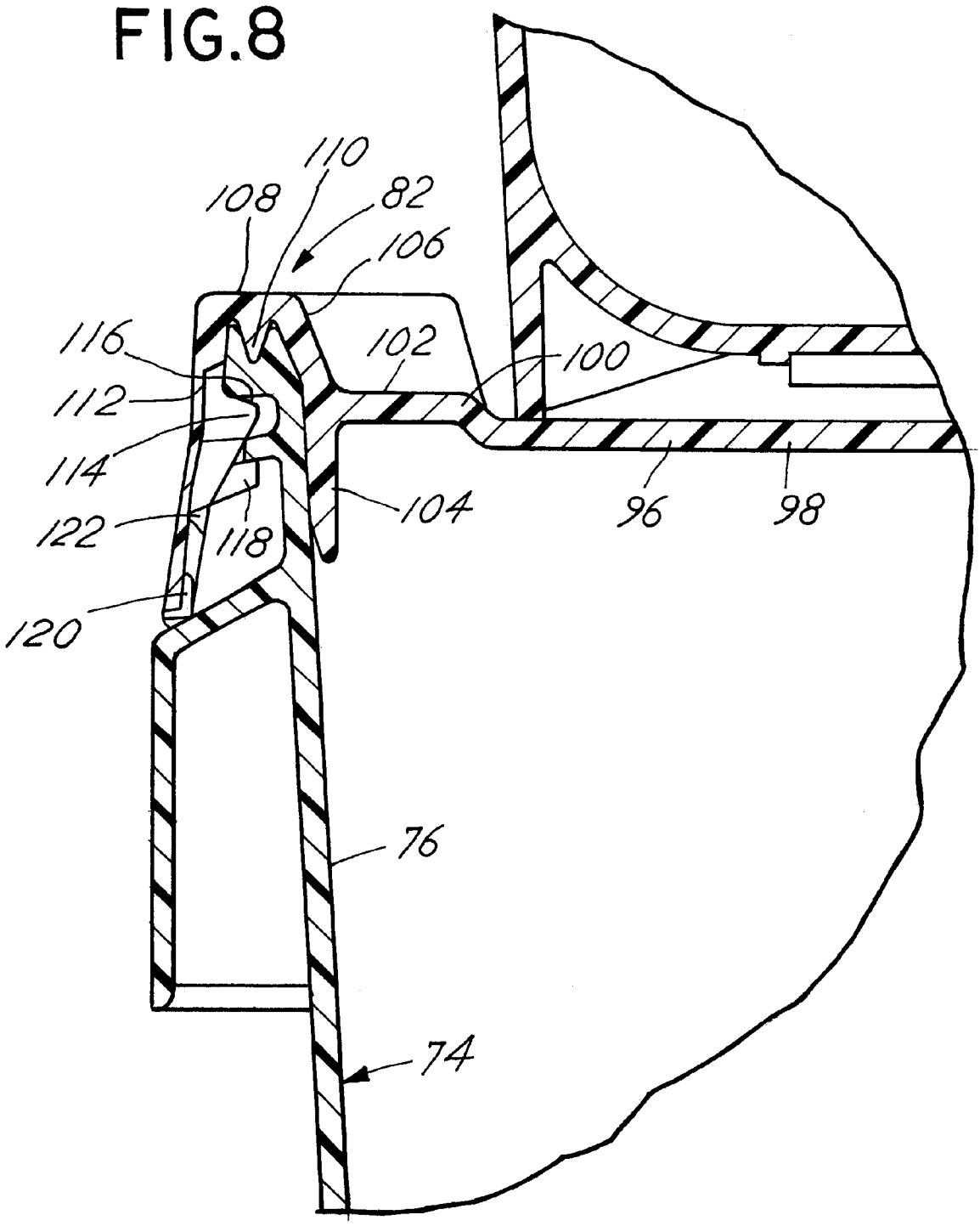
FIG. 8 is an enlarged partial cross sectional view of the lid and bucket construction of FIG. 7.

As depicted in FIGS. 7 and 8, the upper end 82 of the side wall 76 is designed to be used in combination with a lid 96. The lid 96 includes a center circular panel or section 98 which is connected by an inclined annular section 100 to a generally horizontal annular section 102. The annular section 102 connects to a downwardly depending inner circumferential flange 104 and upwardly extending inclined outward extending hoop 106. The hoop 106 further connects with an annular planar section 108 which extends generally horizontally outwardly and perpendicular to the axis 78 when the bucket is in the configuration or orientation depicted in FIG. 6. The annular section 108 includes a downwardly extending tongue seal 110 which fits into the recessed groove 86.

Figure 9:
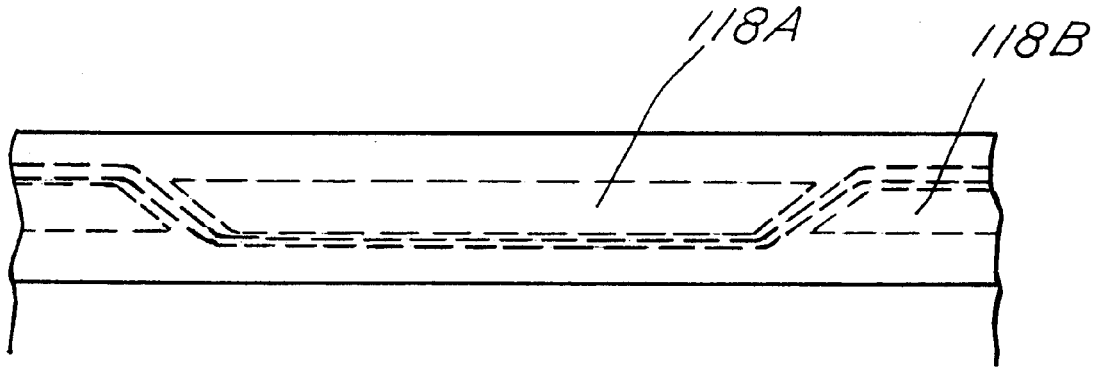
FIG. 9 is partial side elevation of the lid of the embodiment of FIG. 7 illustrating the lid tear strip.
Figure 10:
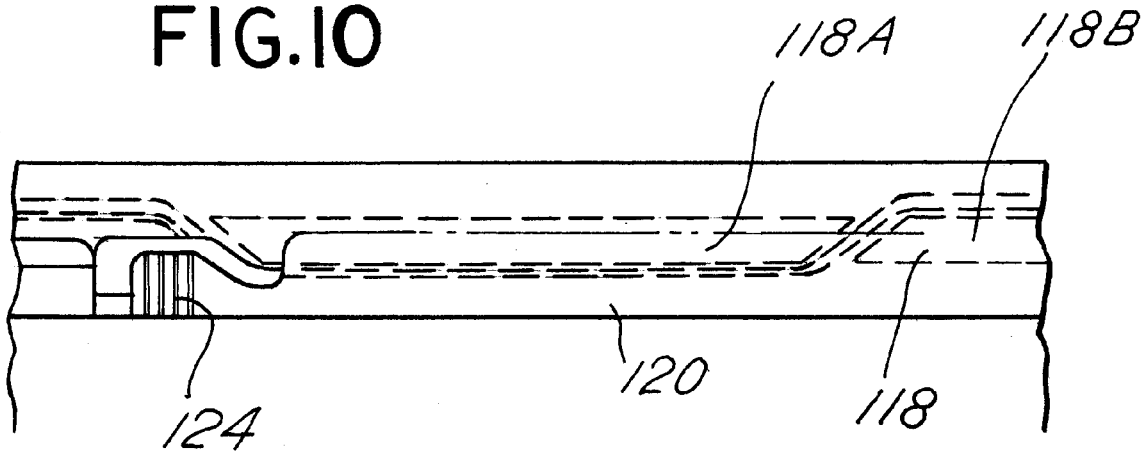
FIG. 10 is a partial side elevation of the lid of the embodiment of FIG. 7 illustrating an end of the lid tear strip.
Figure 11:
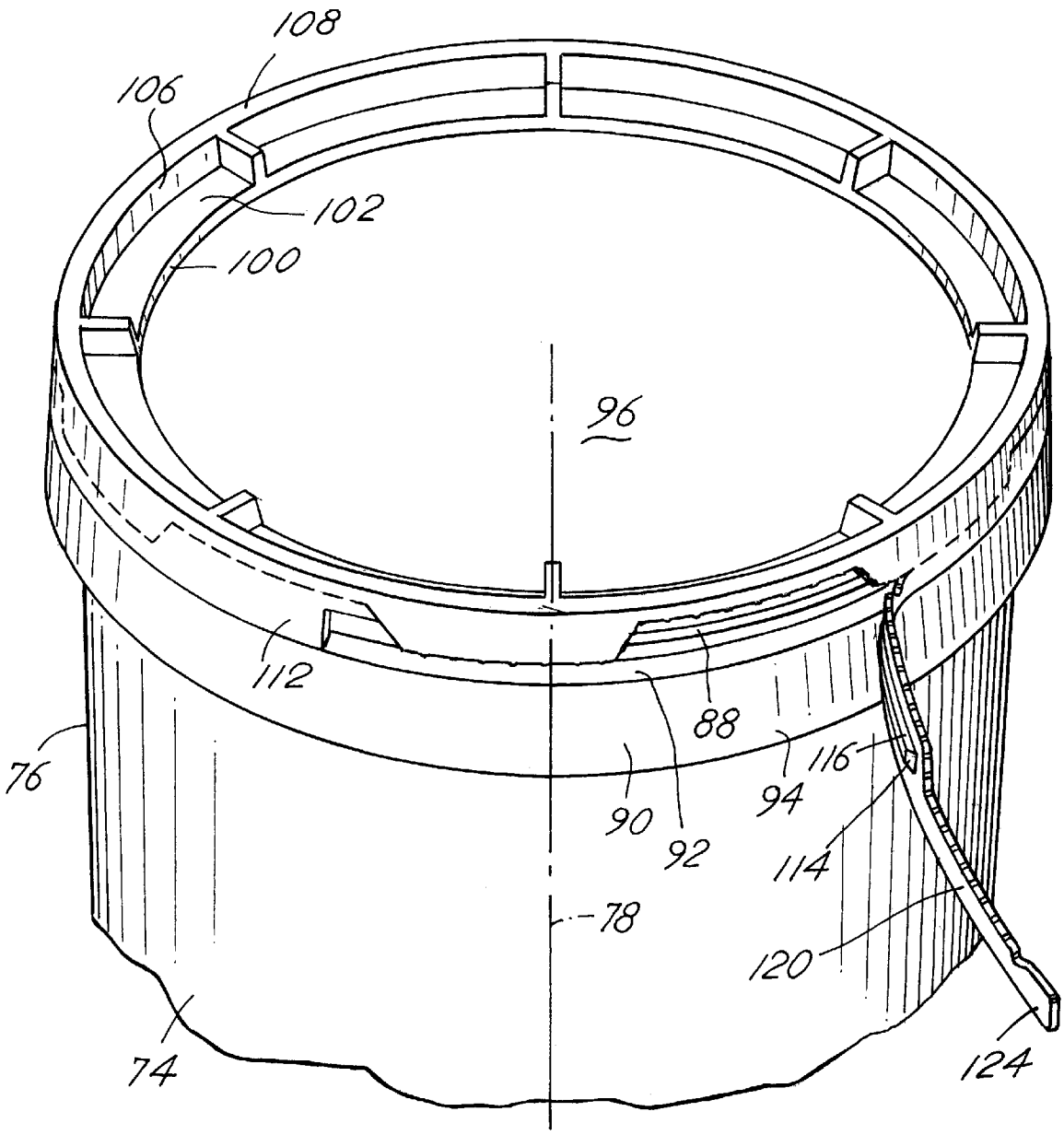
FIG. 11 is an isometric exploded view of a bucket and lid of FIG. 7 with the tear strip partially removed.

The lid of 96 further includes a depending skirt 112 spaced from the flange 104 and extending downwardly from annular section 108. The skirt 112 includes a first, circumferential, inwardly extending flange 114 having a flange surface 116 which engages against the underside of the rib 84. The skirt 112 further includes a second circumferential inwardly extending rib member or flange 118 which cooperates with the bucket rib 88 by engaging the underside thereof. The skirt 112 further includes a downwardly depending section or extension or strip 120 which is connected to the skirt 112 along a junction 122 to define a zigzag tear strip 120 as depicted in greater detail in FIGS. 9 and 10. As shown in FIGS. 9 and 10, the tear strip 120 has a zigzag pattern and incorporates portions or circumferentially spaced segments of the flange 118. Thus, the flange 118 is defined by a series of connected segments such as 118A and 118B in FIGS. 9 and 10. The segments 118A and 118B of the flange 118 are separated by a thin molded portion in the skirt 112 so as to enable removal of the tear strip 120 by gripping or pulling end tab 124 to thereby remove those rib sections 118B maintained on the tear strip 120.

The embodiment of FIGS. 6 through 11 functions in a manner similar to that of the embodiment of FIGS. 2–5. That is the inwardly extending flanges 118 of the lid 96 cooperate with outwardly extending ribs 88 of the bucket 74. A zig zag tear strip is provided which, when removed, eliminates a portion of the locking effect provided by the lower inwardly extending flange 118. Thus, the combination includes a zig zag tear strip and a double locking flange and rib configuration. The combination may further include a downwardly extending tongue 110 of a lid 96 which cooperates with a groove in the top of the bucket. Enhanced hoop strength is provided by the configuration of the elements comprising the lid as well as the elements comprising the open end of the container or bucket. The lid incorporates an arrangement of circular spaced hoops which may be elastically deformed to effect engagement and locking with the open end of the container or bucket. The various hoops provide hoop strength yet also permit appropriate deformation for removal and replacement of the lid.

Various other combinations of ribs, flanges, tear strips, and other elements as described may be utilized without departing from the spirit and scope of the invention. Thus, while there has been set forth preferred embodiments of the invention, it is to be understood that the invention is to be limited only by the following claims and equivalents thereof.

What is claimed is:

1. A container and removable lid construction comprising, in combination:

a container having a side wall with an open top, said top including a first outwardly extending top rib, sale top rib including a top side and an underside, said top side of the top rib including a single upwardly projecting groove, said container also including a second outwardly extending side rib vertically spaced from the first rib and having an underside; and a lid for covering the open top of the container, said lid including a peripheral, depending outer skirt, said outer skirt including:

(a) a first inwardly extending, circumferential locking flange for engaging against the underside of the container top rib, (b) a second inwardly extending, circumferential locking flange for engaging against the underside of the second container side rib, said second locking flange spaced from the first locking flange approximately the distance of the spacing of the container side ribs to enable the locking flanges to retain the lid on the container, (c) a circumferential skirt extension from the second locking flange, said skirt extension comprising a tear strip of material from the skirt including selected portions of the second locking flange, and (d) a single downwardly depending tongue for engaging into the container groove and sealing the lid onto the bucket, said lid retained on the bucket by the first and second flanges.

2. The construction of claim 1 wherein the tear strip includes an end tab for manual gripping.

* * * * *